United States Patent [19]

Alsch

[11] Patent Number: 4,901,046

[45] Date of Patent: Feb. 13, 1990

[54] MANUALLY ACTUATED ON-OFF SWITCH WITH ELECTROMAGNETIC RELEASE

[75] Inventor: Gottfried Alsch, Vienna, Austria

[73] Assignee: Hubert Laurenz Naimer, Nuvola Bianca, Switzerland

[21] Appl. No.: 198,580

[22] Filed: May 25, 1988

[30] Foreign Application Priority Data

Jun. 9, 1987 [AT] Austria ..... 1455/87

[51] Int. Cl.[4] ..... H01H 3/00

[52] U.S. Cl. ..... 335/185; 335/186; 335/122

[58] Field of Search ..... 335/185, 186, 187, 189, 335/190, 164, 106, 121–122

[56] References Cited

U.S. PATENT DOCUMENTS

| | | | |
|---|---|---|---|
| 2,591,336 | 4/1952 | Bordelon | 335/186 |
| 2,611,843 | 9/1952 | Bourne | 335/186 |
| 3,036,174 | 5/1962 | Ardia etal. | 335/122 |
| 4,742,401 | 5/1988 | Andree et al. | 358/292 |

FOREIGN PATENT DOCUMENTS 380973 8/1986 Austria .

*Primary Examiner*—Leo P. Picard
*Assistant Examiner*—Lincoln Donovan
*Attorney, Agent, or Firm*—Nixon & Vanderhye

[57] ABSTRACT

In a manually actuated on-off switch with electromagnetic release, a component part (9) opening and closing the switch contacts and an actuating member, in particular a rotary control grip (2), are designed as separate parts and for being coupled, noting that the component part (9) opening and closing the switch contacts is loaded by a spring in direction out of the take-along position for the closing movement. The component part (9) and the actuating member (2,6) are at least at their mutually facing front surfaces or, respectively, engaging surfaces (7a, 8a) formed of a material being conductive for the magnetic flux and are designed for being coupled one with the other in a force-locking manner by means of the electromagnet.

The coil (10) of the electromagnet is, in this case, preferably arranged for being put to voltage via auxiliary contacts (16).

20 Claims, 9 Drawing Sheets

MANUALLY ACTUATED ON-OFF SWITCH WITH ELECTROMAGNETIC RELEASE

BACKGROUND OF THE INVENTION

1. Field of the Invention

The invention refers to a manually actuated on-off switch with electromagnetic release, in which a component part opening and closing the switch contacts and an actuating member, in particular a rotary control grip, are designed as separate parts and are designed for being coupled.

An electromagnetic release might include an undervoltage release, a no-volt release or a release on account of signals such as, for example, temperature signals.

2. Description of the Prior Art

A switch of the initially mentioned type having a resetting member may, for example, be derived from AT-PS 380 973. Coupling of the component part opening and closing the switch contacts with the actuating member is, in this known switch, effected by means of a lock rod which can be shifted in longitudinal direction of the switch shaft or driving shaft, respectively. For the purpose of achieving a trip-free release, an additional transmission element being held on a further portion of the switch shaft or driving shaft, respectively, is provided in this known switch. This further portion of the switch shaft or driving shaft, respectively, is non-rotatably connected with the manually actuable component part and freely rotatable relative to the second component part, which can be coupled to said manually actuable component part. In this case, the switch shaft is taken along via the cams or the transmission elements connected therewith or is reset via the rods and return springs, noting that it is a premise that the electromagnet is energized, because otherwise the transmission elements can not be maintained in engagement with the elements being arranged for the switching-on operation.

SUMMARY OF THE INVENTION

The invention now aims at providing a manually actuated on-off switch of the initially mentioned type and to simplify its construction and to increase its mechanical reliability. Simultaneously, the invention aims at providing the possibility that the switch, after having been released or cut-off, not only remains in its off-position but that the windings of the electromagnet can, in this off-position, not be unintentionally put under voltage. For solving this task, the switch according to the invention essentially consists in that the component part opening and closing the switch contacts is loaded by a spring in direction out of the take-along position for the closing movement and in that the component part opening and closing the switch contacts and the actuating member are, at least at their opposing faces or banking faces, respectively, formed of a material being conductive for the magnetic flux and are designed for being coupled one with the other in a force-locking manner by means of the electromagnet. On account of the feature to form the component part opening and closing the switch contacts and the actuating member at least at their front faces or banking faces, respectively, facing one another of a material being conductive for the magnetic flux, there is provided the possibility to directly couple said both parts one with the other by using an electromagnet without requiring therefor separate mechanical component parts, noting that, of course, there must exist a closed magnetic flux. As soon as an undervoltage release has taken place, the component part opening and closing the switch contacts and the actuating member are pressed by the springs out of the take-along position for the closing movement into the open position of the contacts, so that these component parts can only again be coupled one with the other after having mechanically approached said both front surfaces facing one another. An essential feature of the switch according to the invention is the trip-free release, which means that, even if the handle is blocked in the on-condition and the coil current circuit is being interrupted, the main contacts are, in spite thereof, brought in off-position. This is a safety feature requested by many prescriptions and making sure that, for example, machines can not automatically start operation after a voltage dump.

The switch according to the invention is in a particularly simple manner designed such that the switch contacts are designed as electrically conductive bridge and that the component part opening and closing the switch contact is supported for being shiftable in transverse relation to the bridge. When effecting a switching-on operation, the switch contacts are drawn into the closed position by the actuating member, noting that such a tractive force is only existent as long as a magnetic flux is maintained through the mutually facing front surfaces of the actuating member and of the component part opening and closing the switch contacts.

For the purpose of preventing any current flow through the electromagnet after a release having taken place and in case of a new voltage rise prior to initiating again a switch-on operation, the arrangement is advantageously selected such that the electromagnet can be put to voltage via auxiliary contacts. Advantageously, these auxiliary contacts shall interrupt the current supply to the electromagnet after a release having taken place, and for this purpose the arrangement can in a particularly simple manner be selected such that the auxiliary contacts of the electromagnet can be coupled, in particular by stop members, with the component part opening and closing the switch contacts and/or with the actuating member.

Coupling of the opening movement of the auxiliary contacts with the opening movement of the switch contacts of the switch can, in a simple manner, be effected if a rod actuating the auxiliary contacts of the electromagnet is coupled with the actuating member, said rod closing the auxiliary contacts prior to initiating the closing movement of the switch contacts. The feature of closing the auxiliary contacts for the electromagnet already prior to initiating the closing movement of the switch contacts of the switch serves the purpose to reliably establish the magnetic flux through the mutually facing front surfaces already at a moment at which the front surface of the actuating member contacts the front surface of the component part opening and closing the switch contacts, so that it is subsequently possible to close the switch contacts of the switch by rotating or pulling the actuating member.

A particularly simple and operationally safe manner of coupling the rod with the actuating member can be achieved if the actuating member is in meshing engagement with a toothed rack crossing the rotational axis of the actuating member. Shifting of this toothed rack when rotating the actuating member allows to achieve the desired coupling and provides the possibility to rotate back the actuating member into its rest position after an undervoltage release. In this case, the toothed rack is advantageously coupled with the rod actuating the auxiliary contacts. A particularly simple manner of coupling the movement of the toothed rack with the rod actuating the auxiliary contacts results if a pin connected with the rod is guided within a coulisse of the toothed rack. Advantageously, the toothed rack is further shiftably supported for being shifted in its axial direction and against the force of a spring into the on-position of the actuating member. After any release having taken place, said spring urges the toothed rack back into the off-position with simultaneous rotation of the actuating member, noting that the rod actuating the auxiliary contacts is simultaneously shifted into a position in which the auxiliary contacts of the electromagnet are in open position. For mechanically relieving the on-position from the spring forces, the rod and the toothed rack may be provided with pawls, which come in mutual engagement in the closed position of the switch contacts, and the rod actuating the auxiliary contacts of the electromagnet may advantageously be itself loaded by a spring and be pressed under the force of the spring into a position in which the auxiliary contacts of the electromagnet are in open position.

The closed position of the auxiliary contacts of the electromagnet may, in this case, be secured by means of an additional protrusion or stop member of the component part opening and closing the switch contacts of the switch and cooperating with the rod. In the event of a release, this component part opening and closing the switch contacts is lifted off the actuating member under the force of the spring, so that also the stop member connected with this part is no more in engagement with the rod for actuating the auxiliary contacts of the electromagnet, and this rod can subsequently be moved into a position in which the separate switch contacts of the electromagnet are in open position.

The actuating member can in a particularly simple manner be designed as a rotary control grip which actuates an axially shiftable part via guide means having the shape of a helix or obliquely extending relative to the axis of rotation, so that a rotating movement can be transformed into an axial shifting movement of the actuating member, noting that, preferably, the component part opening and closing the switch contacts is coupled with the actuating member to be pulled in axial direction when closing the contacts and to be pressed in axial direction when opening the contacts.

In a second embodiment of the switch, the procedure is such that the actuating member is designed as a rotary control grip which actuates via coggings a rotatable member, noting that the component part opening and closing the switch contacts is coupled with the actuating member to be pulled against the force of a spring when closing the contacts and to be pressed when opening the contacts. The rotational movement of the rotary control grip is thus directly utilized for the switching operation, which allows a space-saving construction in axial direction of the switch.

BRIEF DESCRIPTION OF THE DRAWING

In the following, the invention is explained in greater detail with reference to an example of embodiment shown in the drawing.

In the drawing.

DETAILED DESCRIPTION OF THE PREFERRED EMBODIMENTS

Figure 1:
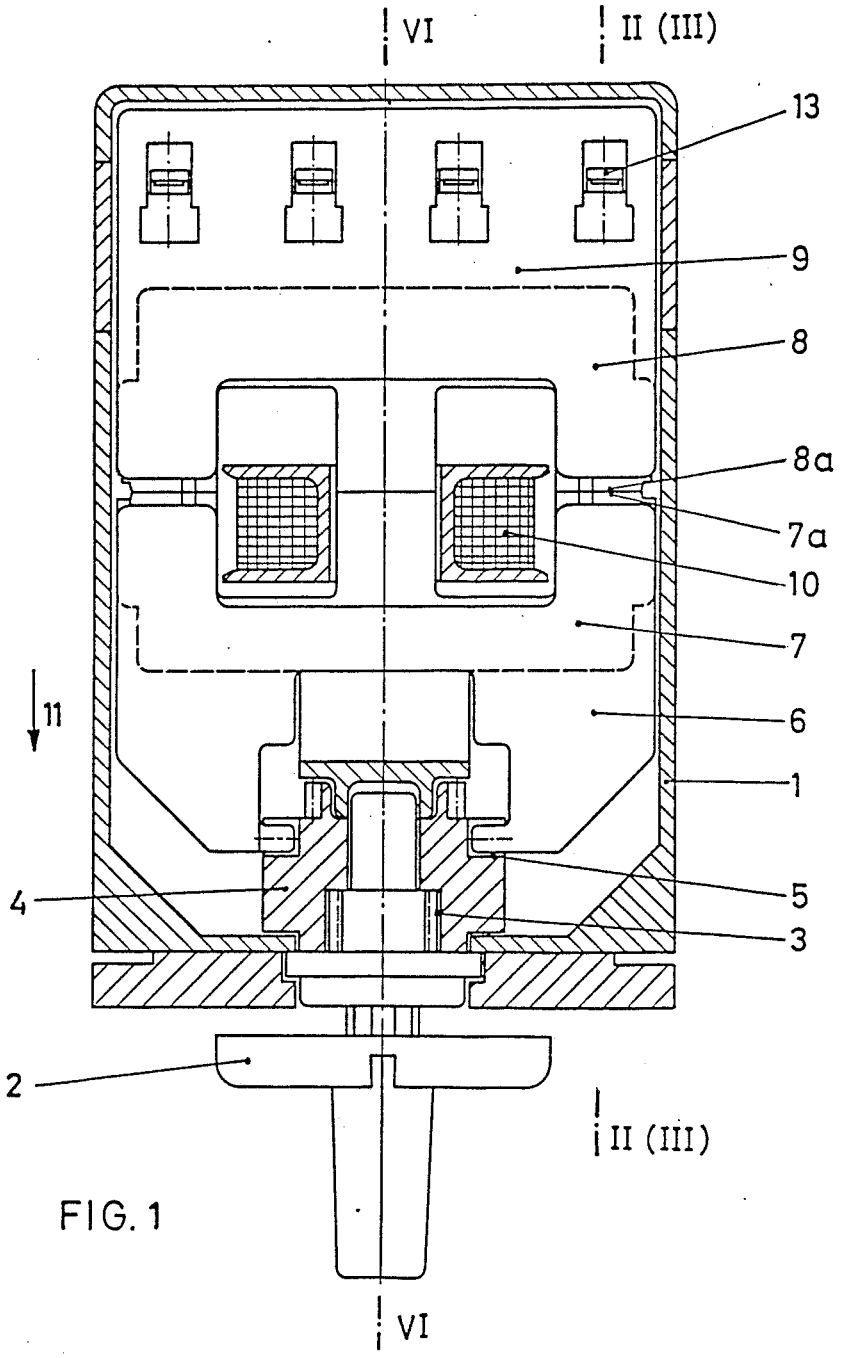
FIG. 1 shows an axial section through a switch according to the invention.

In FIG. 1, there is shown a switch comprising a switch housing 1. A rotary control grip 2 is rotatably supported on this housing 1 and cooperates via a cogging 3 with a rotary part 4. This part 4 comprises, as will become clear in connection with the following Figures, guide grooves 5 having the shape of a helix and being engaged by a part 6 being shiftable in axial direction. The axially shiftable part 6, which cooperates with the actuating member being designed as a rotary control grip, houses an armature magnet 7 consisting at least within the area of the front surfaces 7*a* of a material which is conductive for magnetic flux. At least that area of the front surfaces 7*a* of the magnet yoke 8*a* being located within the component part 9 opening and closing the switch contacts is equally formed of a material being conductive for magnetic flux. The parts 6 and 9 and, respectively, 7 and 8 comprise recesses accommodating a coil 10 being stationarily arranged (not shown in detail) relative to the housing of the switch. On account of the front surfaces 7*a* and 8*a* being formed of a material being conductive for the magnetic flux, it is possible to drag along on account of the magnetic coupling between the front surfaces 7 and 8 the component part 9 opening and closing the switch contacts and to actuate the switch bridges being designated by the reference numeral 12 when actuating, in energized condition of the coil, the rotary control grip 12 and thus shifting the part 6 in direction of the arrow 11.

Figure 2:
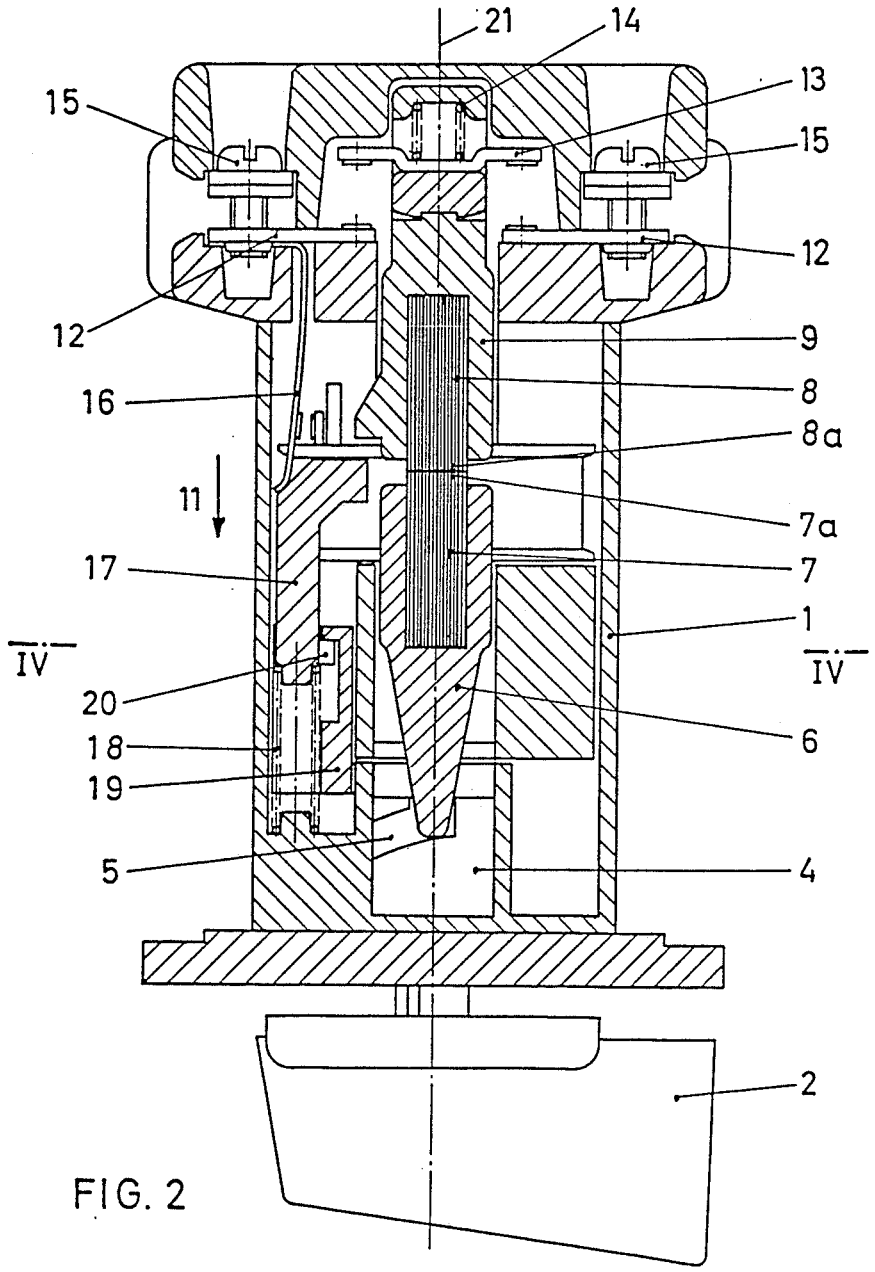
FIG. 2 shows a section along line II—II of FIG. 1 with the switch assuming off-position.

In the representation according to FIG. 2, the switch is shown in off-position. In this representation, there is shown the helix-shaped guide means 5 effecting an axial shifting movement of the part 6 engaging this helix-shaped guide means on occasion of rotating the rotary control grip 2. The parts 8 and, respectively, 8*a* and 7 and, respectively, 7*a* consisting of a material being conductive for the magnetic flux can clearly be seen in FIG. 2. The component part 9 opening and closing the switch contacts carries electrically conductive bridges 13 being each supported by means of a spring 14. The electromagnet is formed of the magnet armature 7 and the magnet yoke 8 providing the closed magnetic circuit and of the coil 10 representing the electric circuit. When moving the parts 6 and 9 in direction of the arrow 11 by rotating the rotary control grip 2, each respective bridge 13 interconnects the switch contacts 12 as is more precisely shown in FIG. 3. For the purpose of connecting the switch contacts 12 with external conduits, not shown in detail, there are provided screws 15.

Reference numeral 16 represents an auxiliary contact cooperating with a rod 17. The auxiliary contact 16 serves the purpose to separately apply voltage to the coil 10. The rod 17 is supported against the force of a spring 18 and is equally moved in direction of the arrow 11 by a stop member or pin 20 cooperating with a toothed rack 19 cooperating with the rotatable part 4, and this when rotating the rotary control grip 2. The helix-shaped guide means 5 of the rotatable part 4 extends in its first partial area in nearly normal relation to the axial direction 21 of the switch, which provides the possibility that the rod 17 causes first closing the auxiliary contact 16 and thus energization of the electromagnet when initiating the rotary movement of the rotary control grip 2 on account of being taken along, as will be explained in the following with greater detail, via the toothed rack, whereupon the part 6 is shifted in direction of the arrow 11 when further rotating the rotary control grip. On account of the coil 10 already being supplied with current at this moment, there results a force-locking coupling between the parts 7 and 8 formed of a material being conductive for the magnetic flux, so that it is possible to close the contacts 12.

Figure 3:
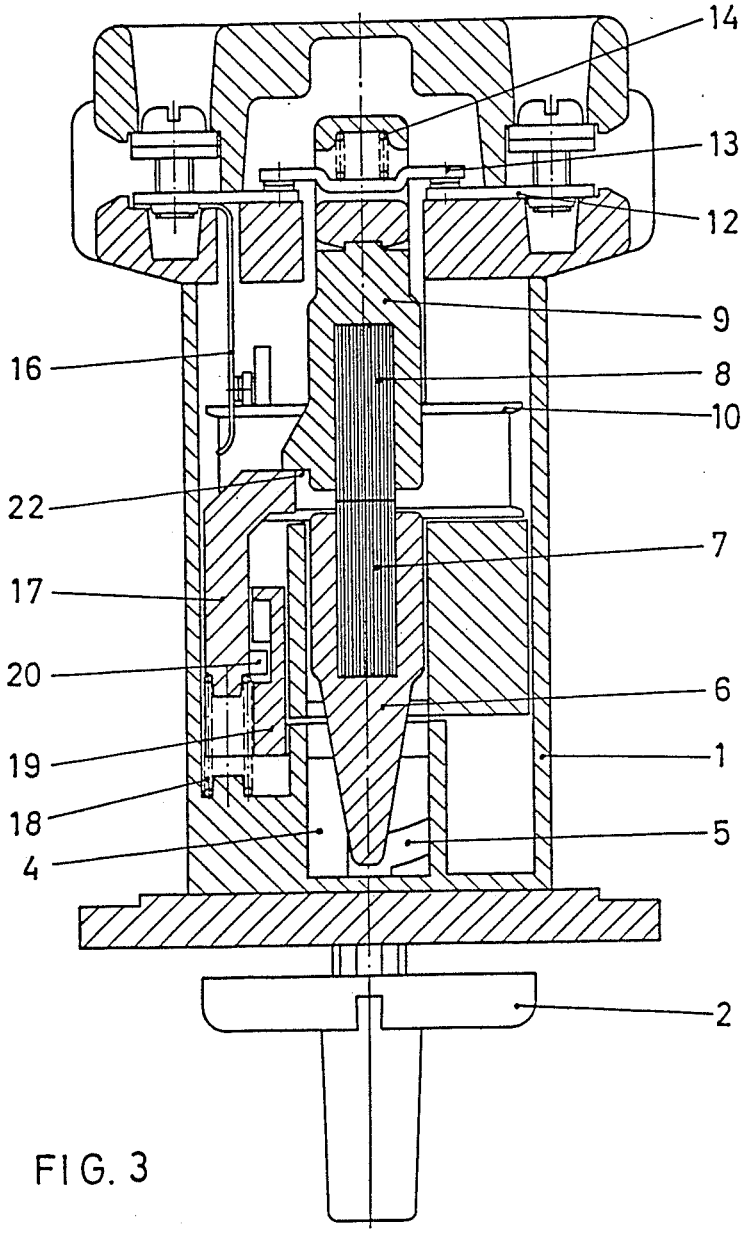
FIG. 3 shows a section analogous to that of FIG. 2 with the switch assuming on-position.

FIG. 3 shows the switch according to the invention in its on-position. The spring 14 exerts a pressing force on the electrically conductive bridge 13 and provides the contact pressure required for a reliable current flow. By supporting the electrically conductive bridge 13 by means of a spring 14, it becomes possible to equalize any unevenness or level difference between the individual switch contacts 12. In the position of the switch according to the invention shown in FIG. 3, the rod 17 is secured by a stop 22 provided on the component part 9 opening and closing the switch contacts. On account of the rod 17 being loaded by a spring 18, it is made sure that the auxiliary contact 16 leading to the coil 10, which is in a pre-loaded condition for closing the contact, will be opened on occasion of a release caused by the electromagnet or on occasion of a switching-off operation.

Figure 4:
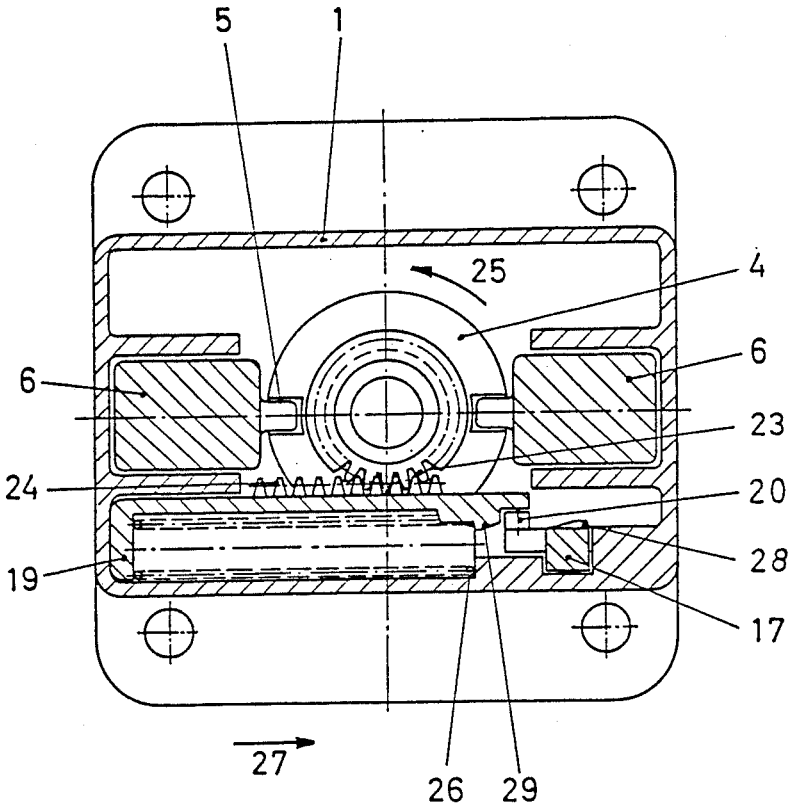
FIG. 4 shows a section along line IV—IV of FIG. 2.

In FIG. 4 there is more exactly shown how the toothed rack 19 cooperates with the rotary control grip. The rotatable part 4 has a cogging 23, which cooperates with a cogging 24 of the toothed rack. When rotating the part 4 in direction of the arrow 25, the toothed rack 19 is moved in direction of the arrow 27 against the force of a spring 26.

Figure 5:
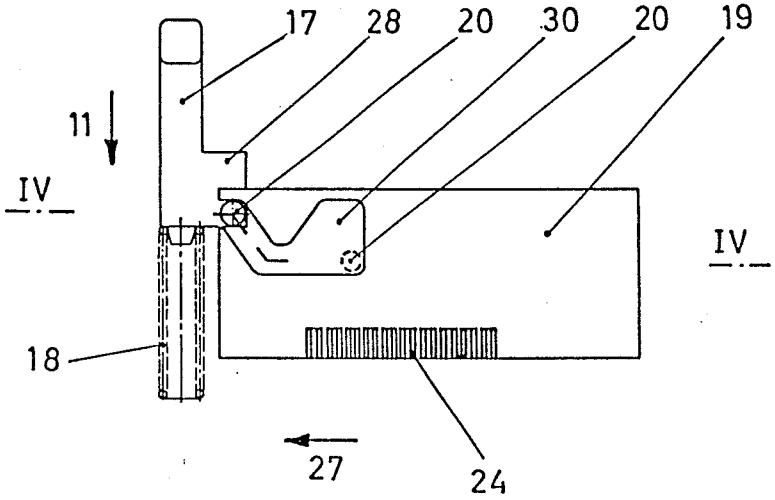
FIG. 5 shows a top plan view of the toothed rack together with the rod actuating the auxiliary contacts and this in an enlarged scale, noting that FIG. 4 represents a section along line IV—IV of FIG. 5.

As is shown in FIG. 5, the toothed rack 19 has in a partial area thereof a coulisse, into which is engaged the pin 20 of the rod 17. When the toothed rack is moved in direction of the arrow 27, the rod is shifted in direction of the arrow 11, which results in closing the auxiliary contact 16 and thus in energizing the electromagnet as has been described above. If, however, no voltage is applied to the entry side of the switch, the electromagnet can not be activated and the component part 9 opening and closing the switch contacts can not be taken along when further rotating the rotary control grip 2. If, however, the electromagnet is energized, closing of the contacts will be effected on account of the force-locking coupling between the parts 7 and 8 and the rod 17 will be kept in its downwardly pressed position against the force of the spring 18 via the stop member 22 of the component part 9 opening and closing the switch contacts. For the purpose of relieving the rod 17 and the toothed rack 19 from the spring forces in the on-position, the rod and the toothed rack are provided with pawls 28,29 which come in mutual engagement in the closed position of the switch contacts. In the closed position of the switch contacts, the pin 20 of the rod 17 assumes the position within the coulisse 30 shown in FIG. 5 in dashed lines.

Figure 6:
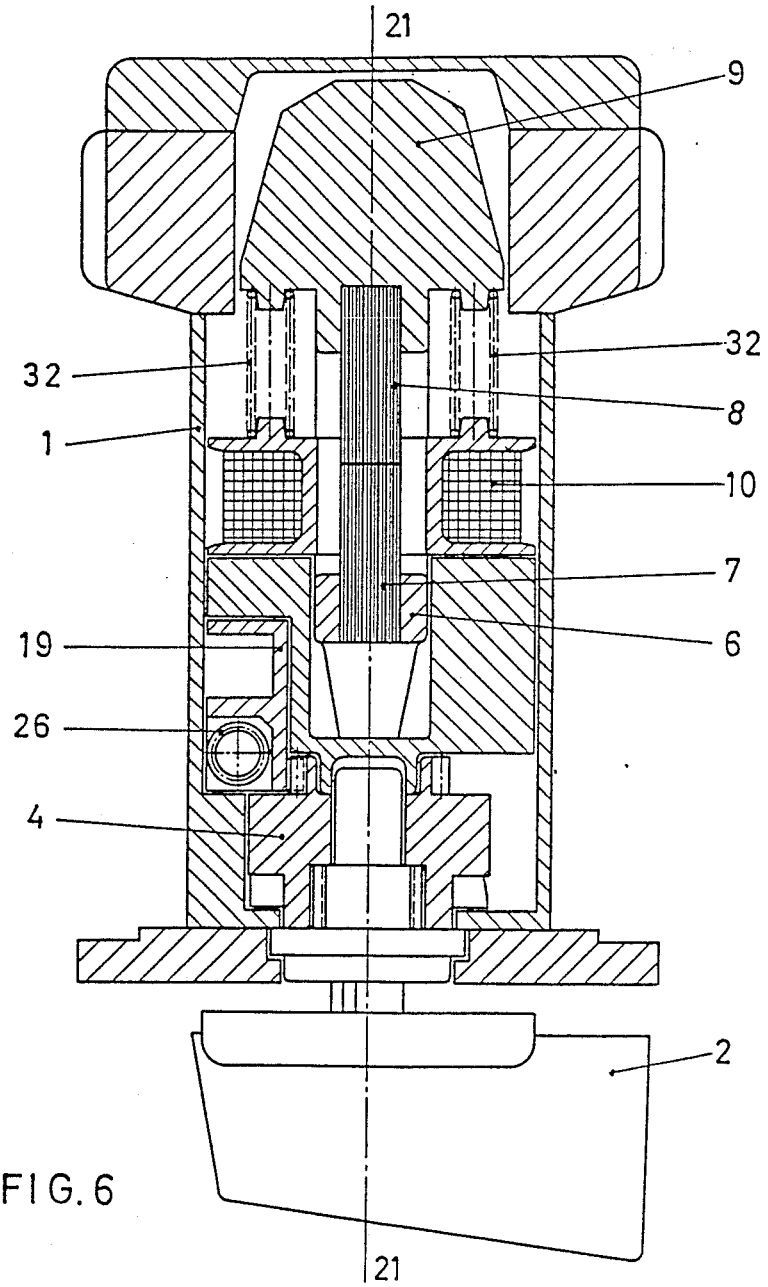
FIG. 6 shows a section along line VI—VI of FIG. 1.

FIG. 6 shows that the part 9 is loaded by springs 32, which may, for example, be supported on the coil 10 and which cause on occasion of a release by the electromagnet the opening of the switch bridge and thus the interruption of the main current circuit.

In the following, the release action shall in short be explained which is, for example, caused by underrunning voltage resulting in a reduction of the magnet force or by a voltage breakdown or by an interruption of the current circuit resulting in suppression of the magnet force. Starting from the closed position shown in FIG. 3, i.e. from the on-position of the switch, a release shall be effected by the electromagnet. On occasion of a reduction or a complete suppression of the magnetic flux induced by the electromagnet in the sections 7 and 8, the force acting at the front surfaces 7*a* and 8*a* is reduced or, respectively, suppressed and the component part 9 is moved under action of the force of the spring 32 in opposite direction to that of the arrow 11, which results in opening the switch contacts. Simultaneously, the rod 17 loaded by the spring 18 moves in opposite direction to that of the arrow 11, because the rod 17 is no more maintained in the downwardly pressed position by the stop member 22 of the part 9. On account of this movement, opening of the auxiliary contact 16 is achieved, which results in interrupting the current flow through the coil 10. As can be derived from FIGS. 4 and 5, this movement of the rod 17 also results in cancelling the locking action of the pawls 28 and 29, and the toothed rack 19 is moved by the force of the spring 26 in opposite direction to that of arrow 27. This movement of the toothed rack 19 causes, via the coggings 23 and 24, movement of the rotary control grip 2 in its off-position. On account of also the rod assuming its starting position in this final position resulting after the release action, also the auxiliary contact 16 reliably assumes open position and the coil 10 can thus not again unintentionally be put to voltage.

An essential feature of the switch according to the invention is the trip-free release, which means that, even if the control grip is blocked in the switched-on condition and the coil current circuit is being interrupted, the main contacts are, in spite thereof, brought in off-position. This is a safety feature required by many regulations and making sure that, for example, machines can not automatically start operation after a voltage breakdown. A new switching-on operation can thus only be started by actuating the rotary control grip 2, noting that there must reliably be provided for the premise that the coil 10 can be put to voltage via the auxiliary contact 16 for achieving coupling between the parts 6 and 9. The component part 9 opening and closing the switch contacts is coupled with the part 6 for closing the contacts 12 in direction of the arrow 11 against the force of the spring 32, while coupling under the action of pressure is effected for opening the contacts in opposite direction to that of the arrow 11 when actuating the rotary control grip.

Figure 7:
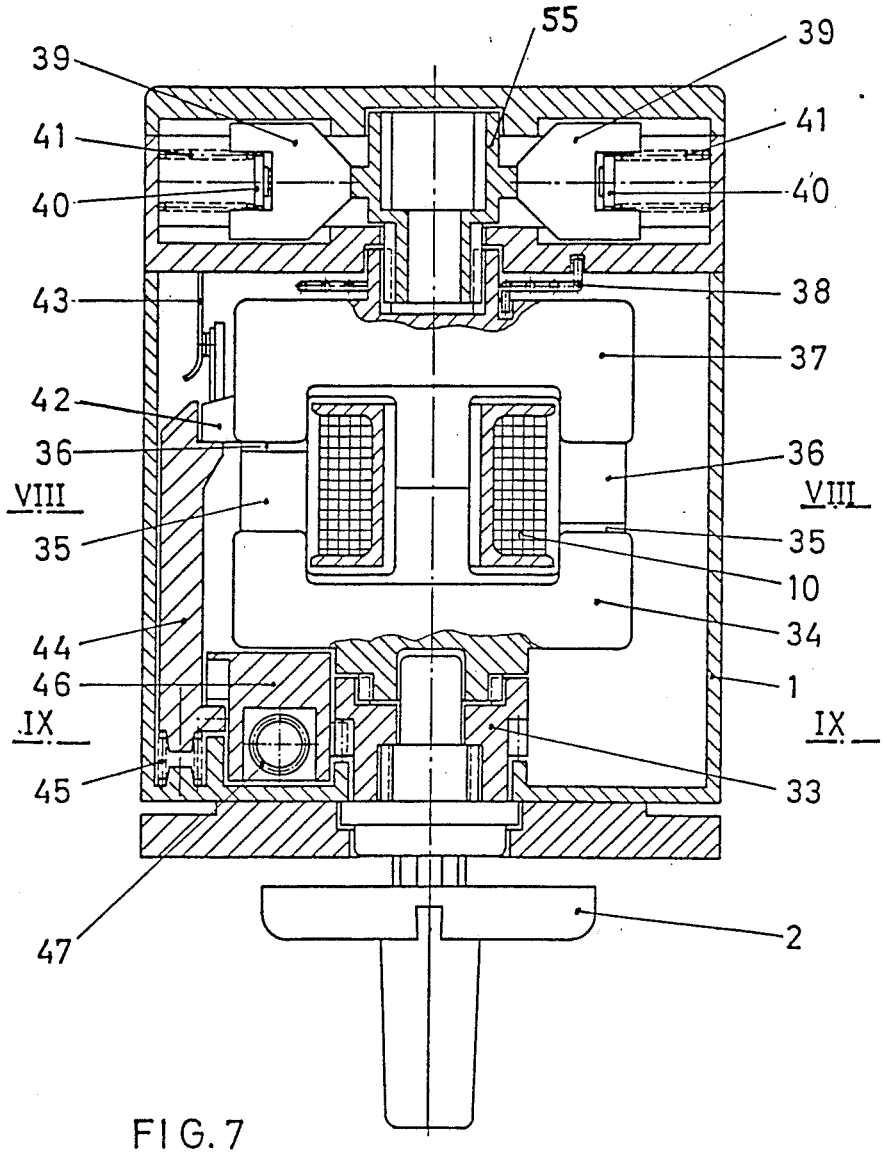
FIG. 7 shows an axial section analogous to that of FIG. 1 through a second embodiment of a switch according to the invention.
Figure 8:
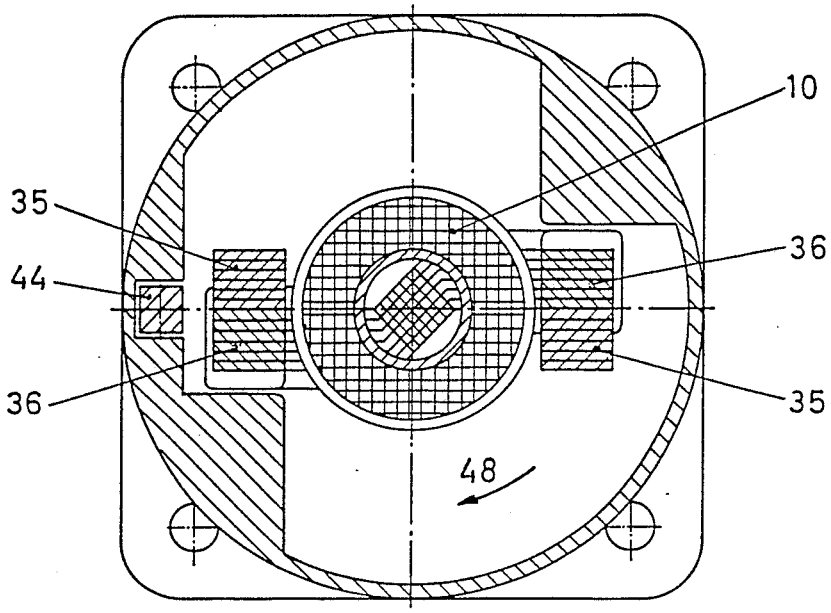
FIG. 8 shows a section along line VIII—VIII of FIG. 7.
Figure 9:
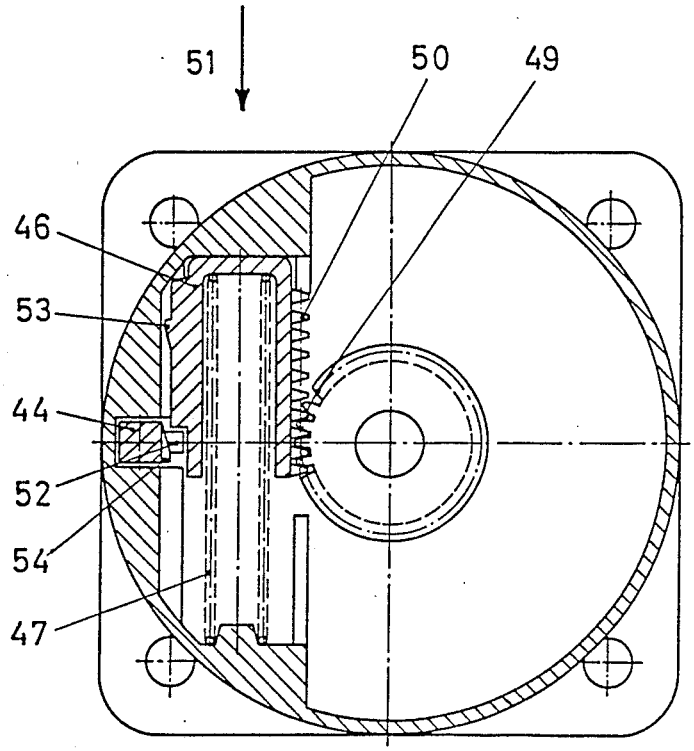
FIG. 9 shows a section along line IX—IX of FIG. 7.

In the FIGS. 7 to 9, there is shown a second embodiment of a switch according to the invention. A rotary control grip 2 is again rotatably supported on a housing 1 and is coupled with a rotatable part 34 with interposition of a rotatable part 33. The part 34 is formed within the area of its front surface or, respectively, engaging surface 35 of a material being conductive for the magnetic flux, and this applies also to the front surface or, respectively, engaging surface 36 of a rotatable part 37. The parts 34 and 37 have within their interior recesses for accommodating a coil 10. A spiral spring is indicated by the reference numeral 38 by means of which spring the component part 37 opening and closing the switch contacts is loaded out of the take-along position for the closed position shown in FIG. 7. The part 37 is, via a profiled pin, coupled with a cam 55, and this cam actuates, via rods 39, the electrically conductive bridges 40 being supported via springs 41, noting that the cam exerts a rotating movement while the rods 39 and the switch bridges 40 exert a linear movement. The part 37 has a stop member 42 which maintains in closed position a rod cooperating with an auxiliary contact 43. The rod 44 is again loaded by a spring 45 and is moved, as will be described in greater detail in the following, by a toothed rack 46 being loaded by the force of a spring 47.

In FIG. 8, there is shown a section within the area of the front surfaces or, respectively, engaging surfaces 35 and 36. When rotating the rotary control grip 2, the engaging surfaces 35 being connected with the part 34 are rotated in direction of the arrow 48. If the coil 10 has been put under voltage by closing the auxiliary contact 43 when starting the rotating movement of the rotary control grip 2, the engaging surfaces 36 of the component part 37 opening and closing the switch contacts are taken along on account of the induced magnetic flux when moving the engaging surfaces 35 in direction of the arrow 48. The component part 37 opening or, respectively, closing the switch contact is also in this embodiment loaded by tension against the force of the spiral spring 38 when closing the contacts, while during the switching-off operation a load in opposite direction to that of the arrow 48 becomes effective by the pressure exerted by the engaging surfaces 35 on the surfaces 36.

The actuation of the rod 44 for closing the auxiliary contact during the rotating movement of the rotary control grip 2 is effected in a similar manner as in connection with the first exemple of embodiment of the switch according to the invention (FIG. 9). A movement of the toothed rack 46 in direction of the arrow 51 against the force of the spring 47 is effected via coggings 49, 50. A pin 52 arranged on the rod 44 is again guided within a coulisse of the toothed rack which is of similar design as in the embodiment shown in FIG. 5. The toothed rack 46 and the rod 44 are again provided with pawls 53 and, respectively, 54, which, in closed position of the switch contacts, come in mutual engagement and provide a relief with respect to the spring force.

The electromagnetic release of this second embodiment of the switch according to the invention is effected in a similar manner as in connection with the first embodiment. In case of a reduction or, respectively, suppression of the magnetic flux induced by the coil 10 in the front surfaces or, respectively, engaging surfaces 35 and 36 of the rotatable parts 34 and 37, there results rotation of the part 37 by the force of the spring 38 in opposite direction to that of the arrow 48. On account thereof, the stop member 42 is disengaged from the rod 44, which moves on account of the force of the spring 45 in direction to the auxiliary contact 43 and opens this contact. During this movement, the pawls 53 and 54 become simultaneously disengaged, whereby the toothed rack is shifted in opposite direction to that of the arrow 51 and the toothed rack rotates the rotary control grip into the off-position via the coggings 49 and 50. As has already been explained in detail, a new switching-on operation can also in this embodiment only be effected by rotating the rotary control grip 2, because no voltage can be applied to the electromagnet.

On account of the component part opening and closing the switch contacts being in both embodiments loaded by a spring in direction out of the take-along position for the closing movement, any release by the electromagnet is accompanied by an interruption of the coupling between the respective engaging surfaces or, respectively, front surfaces formed of a material being conductive for the magnetic flux, which results in opening the switch contacts. Switching-on of the switch according to the invention is only possible if voltage can be applied to the electromagnet by closing the auxiliary contacts and if thus is made possible a force-locking coupling between the actuating member and the component part opening and closing the switch contacts. After an electromagnetic release, the switch is automatically brought into its off-position, and the windings of the electromagnet can not again unintentionally be put under voltage in this off-position.

What is claimed is:

1. A trip free release manually actuated on-off electrical switch comprising:

switch contacts including a movable contact mounted for movement between an open and a closed position;

an actuating member;

a connecting component for operatively connecting said movable contact to said actuating member, with coupling means, to move said movable contact between said open and closed positions in response to actuation of said actuating member;

spring means for biasing said connecting component to a position in which said switch contacts are in said open position, with a given spring biasing force;

an electromagnet; and said coupling means comprising magnetic material means for operatively coupling said actuating member and said connecting component together with a first coupling force in response to a magnetic flux applied by said electromagnetic, said first coupling force being greater than said spring biasing force, and coupling said actuating member and said connecting component together with a second coupling force if a magnetic flux is not applied by said electromagnet, said second coupling force being less than said spring biasing force, so that if said electromagnet is energized the movement of said movable contact is controlled precisely by movement of said actuating member, and when said electromagnet is de-energized, said movable contact moves to said open position regardless of the position of said actuating member.

2. An electrical switch as recited in claim 1 wherein said actuating member comprises a linearly moveable element, a rotary knob, and means for translating rotary movement of said knob into linear movement of said linearly moveable element.

3. An electrical switch as recited in claim 1 wherein said switch contacts comprise a pair of stationary contacts and said movable contact, said movable contact comprising a bridge, said bridge mounted to said connecting component.

4. An electrical switch as recited in claim 1 wherein said electromagnet is operatively connected to auxiliary contacts which control energization and de-energization of said electromagnet.

5. An electrical switch as recited in claim 4 wherein said auxiliary contacts are operatively coupled to said connecting component.

6. An electrical switch as recited in claim 4 wherein said auxiliary contacts are operatively coupled to said actuating member.

7. An electrical switch as recited in claim 6 wherein said auxiliary contacts are operatively coupled to said actuating member by rod means for effecting closing of said auxiliary contacts prior to initiating closing of said switch contacts.

8. An electrical switch as recited in claim 7 further comprising a toothed rack operatively connected to said actuating member, said rod means being coupled to said rod means.

9. An electrical switch as recited in claim 8 further comprising a pin connected to said rod means and guided within a coulisse of said toothed rack.

10. An electrical switch as recited in claim 9 wherein said actuator member includes a rotary knob, and further comprising spring means for biasing said toothed rack and said rotary knob to the switch open position of said knob.

11. An electrical switch as recited in claim 7 further comprising spring means for biasing said rod means into a position in which said auxiliary contacts are open.

12. An electrical switch as recited in claim 8 further comprising pawls, associated with said rod means and said toothed rack, mutually engaging each other when said switch contacts are in said closed position.

13. An electrical switch as recited in claim 1 wherein said connecting component and said actuating member are mounted so that they are subjected to tension forces during closing of the switch contacts, and compression forces during opening of the switch contacts.

14. An electrical switch as recited in claim 1 wherein said actuating member comprises a rotary knob, a rotatable element, and coggings connecting said rotary knob to said rotatable element; and said connecting member connected to said actuating member in such a way that it is subjected to tension forces during closing of the switch contacts, and compression forces during opening.

15. An electrical switch as recited in claim 1 wherein said electromagnet is mounted so that it surround said coupling means.

16. An electrical switch as recited in claim 4 wherein said electromagnet is mounted so that it surrounds said coupling means.

17. An electrical switch as recited in claim 16 wherein said actuating member comprises a linearly moveable element, a rotary knob, and means for translating rotary movement of said knob into linear movement of said linearly moveable element.

18. An electrical switch as recited in claim 17 wherein said switch contacts comprise a pair of stationary contacts and said movable contact, said movable contact comprising a bridge, said bridge mounted to said connecting component.

19. An electrical switch as recited in claim 15 wherein said switch contacts comprise a pair of stationary contacts and said movable contact, said movable contact comprising a bridge, said bridge mounted to said connecting component.

20. An electrical switch as recited in claim 15 wherein said actuating member comprises a linearly moveable element, a rotary knob, and means for translating rotary movement of said knob into linear movement of said linearly moveable element.

* * * * *